US005424115A

United States Patent [19]

Stokes

[11] Patent Number: 5,424,115

[45] Date of Patent: Jun. 13, 1995

[54] POINT BONDED NONWOVEN FABRICS

[75] Inventor: Ty J. Stokes, Suwanee, Ga.

[73] Assignee: Kimberly-Clark Corporation, Neenah, Wis.

[21] Appl. No.: 201,582

[22] Filed: Feb. 25, 1994

[51] Int. Cl.[6] ..... B32B 27/14

[52] U.S. Cl. ..... 428/198; 156/209; 156/296; 156/308.2; 156/308.4; 156/309.6; 156/555; 428/171; 428/288; 428/296; 428/373; 428/374

[58] Field of Search ..... 428/373, 288, 195, 198, 428/171, 360, 296, 374; 156/209, 296, 308.4, 308.2, 309.6, 555

[56] References Cited

U.S. PATENT DOCUMENTS

| | | | |
|---|---|---|---|
| 3,117,906 | 1/1964 | Tanner | 161/177 |
| 3,200,440 | 8/1965 | Bryan et al. | 18/8 |
| 3,297,807 | 1/1967 | Settele | 264/171 |
| 3,536,802 | 10/1970 | Uraya et al. | 264/171 |
| 3,725,192 | 4/1973 | Ando et al. | 161/175 |
| 3,780,149 | 12/1973 | Keuchel et al. | 264/168 |
| 3,787,162 | 1/1974 | Cheetham | 425/463 |
| 3,788,940 | 1/1974 | Ogata | 161/173 |
| 3,855,045 | 12/1974 | Brock | 161/146 |
| 3,895,151 | 7/1975 | Matthews et al. | 428/102 |
| 3,924,045 | 12/1975 | Ogasawara et al. | 428/373 |
| 3,940,302 | 2/1976 | Matthews et al. | 156/167 |
| 4,005,169 | 1/1977 | Cumbers | 264/103 |
| 4,035,219 | 7/1977 | Cumbers | 156/290 |
| 4,211,816 | 7/1980 | Booker et al. | 428/296 |
| 4,306,929 | 12/1981 | Menikheim et al. | 156/290 |
| 4,396,366 | 8/1983 | Kessler et al. | 425/131.5 |
| 4,424,257 | 1/1984 | Bach | 428/370 |
| 4,424,258 | 1/1984 | Bach | 428/370 |
| 4,555,430 | 11/1985 | Mays | 428/134 |
| 4,588,630 | 5/1986 | Shimalla | 428/131 |
| 4,596,742 | 6/1986 | Selivansky et al. | 428/373 |
| 4,601,949 | 7/1986 | Bach et al. | 428/374 |
| 4,761,322 | 8/1988 | Raley | 428/198 |
| 4,774,124 | 9/1988 | Shimalla | 428/171 |
| 4,806,299 | 2/1989 | Burns | 264/171 |
| 4,830,904 | 5/1989 | Gessner et al. | 428/219 |
| 4,981,749 | 1/1991 | Kubo et al. | 428/219 |
| 5,071,705 | 12/1991 | Tanaka et al. | 428/370 |
| 5,143,786 | 9/1992 | Tanaka et al. | 428/357 |
| 5,167,764 | 12/1992 | Nielsen et al. | 162/146 |
| 5,207,970 | 5/1993 | Joseph et al. | 264/518 |

FOREIGN PATENT DOCUMENTS 0088744 9/1983 European Pat. Off. .

OTHER PUBLICATIONS

J. Lunenschloss & W. Albrecht (Ed.)/Ellis Horwood Ltd: "Nonwoven Bonded Fabrics": pp. 311–314 (1985).

R. J. Rogers: "Methods, Materials and Products of Thermal Bonding" in Principles of Nonwovens: pp. 633–650.

A. Drelich: "Thermal Bonding with Fusible Fibers" in Nonwovens Industry, Sep. 1985, pp. 12–26.

L. M. Landoll & B. J. Hostetter: "Dependence of Thermal Bonded Coverstock Properties on Polypropylene Fiber Characteristics" in Polypropylene Fibers and Textiles IV, Sep. 1987, pp. 41/1–41/8.

P. Olivieri, M. Branchesi & T. Ricupero: "Thermal Bonding–The Fastest–Growing Application for Polypropylene Staple: Success and Development" in Polypropylene Fibers and Textiles IV, Sep. 1987, pp. 40/1–40/10.

*Primary Examiner*—James J. Bell
*Attorney, Agent, or Firm*—Michael U. Lee

[57] ABSTRACT

The present invention provides a point bonded polyolefin nonwoven fabric fabricated from conjugate fibers containing a polyolefin and a polyamide. Advantageously, the nonwoven fabric can be point bonded at a temperature significantly below conventional polyolefin nonwoven web bonding temperatures and in a wide range of different bonding temperatures without significantly sacrificing its tensile strength. Additionally provided is a process for producing the point bonded nonwoven fabric.

20 Claims, 4 Drawing Sheets

POINT BONDED NONWOVEN FABRICS

The present invention relates to bonded nonwoven fiber webs. More particularly, the present invention relates to point-bonded nonwoven webs of polyolefin/-nylon conjugate fibers.

It is known in the art to make discretely bonded nonwoven fabrics by hot calendering fiber webs which contain melt-fusible thermoplastic fibers. Such hot calendering is effected by passing the fiber web through the nip between counterrotating heated bonding rolls, of which one or both of the rolls may have raised projections or patterns, to provide proper combinations of temperature and pressure settings to melt-fuse the fibers at selected regions of the web. The strength of bonded fabrics is highly correlated to the temperature of the heated rolls. In general, there are optimal bonding temperature for obtaining machine direction (MD) and crossmachine direction (CD) tensile strength for thermoplastic nonwoven fabrics. For example, Landoll et al., *Dependence of Thermal Bonded Coverstock Properties on Polypropylene Fiber Characteristics*, The Plastics and Rubber Institute, Fourth International Conference on Polypropylene Fibers and Textiles, University of Nottingham, England, September, 1987, discloses that polypropylene fabrics bonded at a temperature below the peak bonding temperature tend to fail by delamination or disintegration of the bond points, while the fabrics bonded at a temperature above the peak bonding temperature fail by fiber breakage at the edge of the bond points. Landoll et al. further teaches that at the peak bonding temperature, both of the failure modes are present although the delamination failure mode dominates. In general, the peak bonding temperature is near the melting point of the thermoplastic fiber, which is a sufficiently high temperature to melt-fuse the fibers when the web travels quickly through the nip. Conventionally, the bonding roll temperature for polyolefin fiber webs needs to be higher than about 10° C. below the melting point of the fiber polymer to provide properly bonded webs. However, as the web traveling speed increases and, thus, as the residence time of the web in the nip of the bonding rolls decreases, the physical strength, especially tensile strength, of the resulting bonded fabric decreases. It is believed that the strength decrease is caused by insufficient heat transfer from the bonding rolls to the web fibers, resulting in inadequate melt-fusion among the fibers at the bonding points. This decrease in bond strength, however, can be partially compensated by raising the temperature of the bonding rolls. This approach again has a severe limitation. As the bonding temperature is raised above the melting point of the fiber polymer, the polymer starts to stick to the bonding roll, forming thermally induced defects on the fiber web. When the bonding roll temperature increases substantially above the melting point of the fiber polymer, the web sticks to the bonding rolls, rendering the bonding process inoperable. Consequently, it is imperative that the temperature of the bonding roll must be carefully monitored. This need for proper control of the bonding roll temperature is especially critical for nonwoven fiber webs that are fabricated from polymers that have a sharp melting point, such as, linear low density polyethylene.

It is also known that thermoplastic fiber webs can be point bonded using bonding rolls that are heated to a temperature below the softening point of the fiber polymer. In general, such low-temperature bonding approaches are utilized to produce soft and drapable nonwoven fabrics. Typical low-temperature bonding processes utilize patterned bonding rolls and avoid thermal fusion of the web fibers that are positioned between adjacent bonding points by effecting melt-fusion bonds only at the raised points of the bonding rolls, i.e., at the bonding points. For example, U.S. Pat. No. 4,035,219 to Cumbers discloses such a point bonding process and fabrics made therefrom. However, as is known in the relevant art and as described above, the integrity and physical strength of a bonded fabric are highly correlated to the temperature of the bonding rolls, provided that the bonding roll temperature is not so high as to render the bonding process inoperable or to thermally degrade the fibers. Correspondingly, nonwoven fabrics bonded at a temperature significantly below the melting point of the fibers tend to have weak bond points, although these under bonded fabrics tend to exhibit improved drapability and softness.

Although prior art point bonded polyolefin nonwoven fabrics are suitable for many different uses, certain applications for nonwoven fabrics require the use of highly bonded and high tensile strength nonwoven fabrics that also exhibit soft texture and hand. Consequently, it is desirable to provide high tensile strength nonwoven fabrics that are strongly bonded at the bond points but the fibers between the bond points are free of any significant interfiber fusion. In addition, it is highly desirable to provide nonwoven webs that can be point bonded at a wide range of bonding temperatures.

SUMMARY OF THE INVENTION

There is provided a process for producing a point-bonded nonwoven fabric of conjugate fibers containing a polyolefin and a polyamide. The process includes the steps of depositing the conjugate fibers on a forming surface to form a nonwoven web, and passing the web into a nip formed by two abutting bonding rolls, wherein the bonding rolls are heated to a temperature lower than about 10° C. below the melting point of the polyolefin component and the bonding rolls provide a nip pressure on raised points between about 3,000 to about 180,000 psi.

Further provided is a point bonded nonwoven conjugate fiber web having point bonds that are stronger than the conjugate fibers of the web. The bond points of the nonwoven fiber web are formed in a nip between two abutting heated bonding rolls, and the nonwoven fiber web contains conjugate fibers which contain a polyolefin component and a polyamide component, wherein the polymer components are arranged to occupy substantially distinct sections of each of the conjugate fibers along the length of the fibers.

Additionally provided is a nonwoven fiber web having a wide bonding temperature range. The fiber web containing conjugate fibers which have a polyolefin component and a polyamide component, and the polymer components are arranged to occupy substantially distinct sections of the conjugate fibers along the length of the fibers.

The point bonded nonwoven polyolefin fabric of the present invention provides high tensile strength and yet has good hand and softness even when the fabrics are bonded at a temperature substantially lower than the conventional polyolefin fabric bonding temperatures. In addition, the nonwoven fabric has a wide range of bonding temperatures.

DETAILED DESCRIPTION OF THE INVENTION

Figure 1:
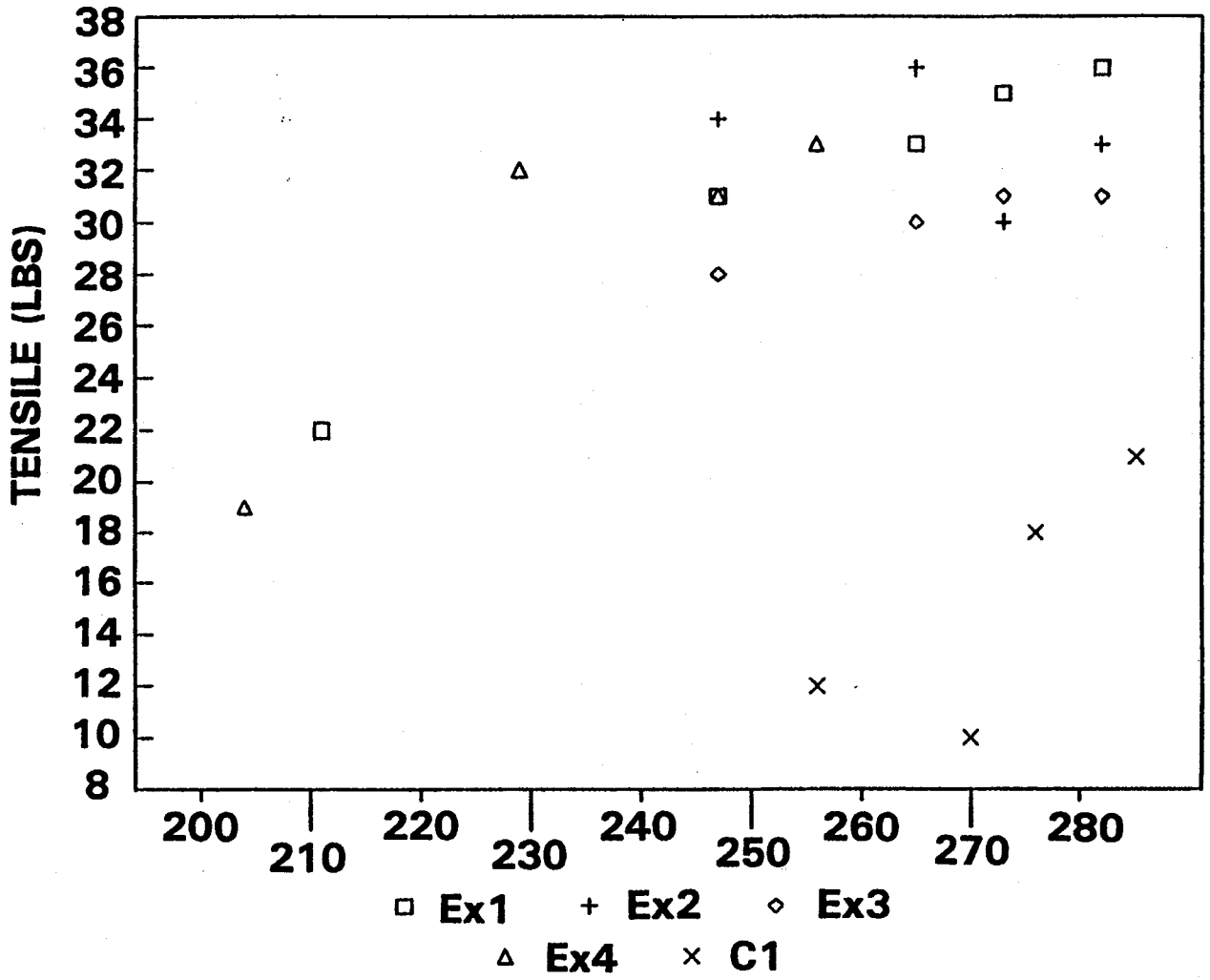
FIG. 1 is a graphical presentation of the MD tensile strength of the present point bonded fabrics and the control fabrics.

The present invention provides a polyolefin nonwoven fiber web that has a wide range of bonding temperatures and can be strongly bonded at a temperature lower than the conventional bonding temperatures for polyolefin nonwoven webs. The present nonwoven webs are fabricated from conjugate fibers containing a polyolefin component and a polyamide component. Desirably, the conjugate fibers contain about 20 to about 80 wt %, more desirably about 30 to about 70 wt %, most desirably about 40 to about 60 wt % of a polyolefin component, and about 80 to about 20 wt %, more desirably about 70 to about 30 wt %, most desirably about 60 to about 40 wt % of a polyamide component.

In accordance with the present invention, the nonwoven webs are point bonded at a temperature below the melting point of the polyolefin component of the conjugate fibers in combination with a nip pressure on raised points of the bonding rolls of from about 3,000 to about 180,000 psi, preferably from about 10,000 to 150,000 psi. Desirably, the webs are point bonded with bonding rolls that have a surface temperature of about 10° C. below the melting point of the polyolefin component. More desirably, the webs are point boned at a temperature from about 10° C. to about 80° C., preferably from about 15° C. to about 70° C., more preferably from about 20° C. to about 60° C., most preferably from about 25° C. to about 50° C., below the melting point of the polyolefin component. The point bonded fabrics of the present invention desirably have a grab tensile strength in MD of at least about 15 lbs, more desirable at least about 25 lbs, as measured in accordance with Federal Standard Methods 191A, Method 5100.

It has unexpectedly been found that the fiber webs of the present invention can be bonded at a wide range of temperatures and can be bonded even at a temperature significantly lower than the softening point of the polyolefin component without significantly sacrificing the physical strength of the nonwoven fabric produced therefrom. Furthermore, it has been found that unlike the bond strength of conventional point bonded polyolefin fiber webs, as discussed above, the bond strength of the present point bonded webs is stronger than the individual fibers forming the webs, i.e., the point bonded fabrics do not fail at the bond points or around the edges of the bond points when force is applied, so long as the bonding temperature applied is not at the lower portion of the present bonding temperature range. The present point bonded nonwoven fabrics tend to fail only when high enough force is applied to break the fibers that are positioned and affixed between the bond points. The strength of the nonwoven fabric is highly unexpected since it is well known in the art that polyolefins and polyamides in general are highly incompatible and that conjugate fibers containing the two polymer components readily split. Consequently, it is known that conjugate fibers of a polyolefin and a polyamide and fabrics made therefrom do not provide high physical integrity. Such physical integrity problem of polyolefin/polyamide conjugate fiber is, for example, addressed in U.S. Pat. No. 3,788,940 to Ogata et al.

The advantageous properties of the present point bonded fabric are fully realized when the fiber web is bonded in an intermittent manner. Suitable intermittently bonded fabrics can be produced by passing a nonwoven fiber web through the nip of a pair of counterrotating patterned heated rolls or of a patterned heated roll paired with a counterrotating smooth roll. Such intermittent bonding processes are well known in the art and, for example, disclosed in U.S. Pat. Nos. 3,855,045 to Brock and 3,855,046 to Hansen et al. Patterned bonding rolls suitable for the present invention have a plurality of raised points, in general, of a repeating pattern. The pattern of raised points is generally regular and is selected such that sufficient overall bonded area is present to produce a bonded web with adequate bonded points to provide sufficient physical integrity and tensile strength. In general, the pattern of raised points in the bonding rolls useful for the present invention is such that the total bonded area of the web is about 5% to about 50% of the total web surface area and the bond density is about 50 to 1,500 compacted points per square inch.

Conjugate fibers suitable for the present invention include spunbond fibers and staple fibers. Suitable configurations for the conjugate fibers of the present invention are conventional conjugate fiber configurations including sheath-core, e.g., concentric sheath-core and eccentric sheath-core, and island-in-sea conjugate fiber configurations that have at least two distinct sections, which are occupied by distinct polymers, along the length of the fibers. Of these configurations, more desirable are sheath-core configurations. Suitable conjugate fibers have the sheath or the sea of the fibers formed from a polyolefin and the core or the island formed from a polyamide. As used herein, the term "spunbond fibers" refers to fibers formed by extruding molten thermoplastic polymers as filaments or fibers from a plurality of relatively fine, usually circular, capillaries of a spinneret, and then rapidly drawing the extruded filaments by an eductive or other well-known drawing mechanism to impart molecular orientation and physical strength to the filaments. The drawn fibers are then deposited onto a forming surface in a highly random manner to form a nonwoven web having essentially a uniform density. Conventional spunbond processes known in the art are disclosed, for example, in U.S. Pat. Nos. 4,340,563 to Appel et al. and 3,692,618 to Dorschner et al. Conjugate spunbond fibers and webs therefrom can be produced with conventional spunbond processes by replacing the conventional monocomponent spinneret assembly with a bicomponent spinneret assembly, for example, described in U.S. Pat. No. 3,730,662 to Nunning. Suitable staple fibers can be produced from any known bicomponent staple fiber forming process. Suitable processes for producing conjugate staple fibers are well known in the art. Briefly, a typical staple fiber production process includes the steps of forming strands of continuous fibers which are spun with any well known staple fiber spinning process equipped with a conjugate fiber spinneret assembly, drawing the strands to impart physical strength and cutting the drawn strands to staple lengths. Subsequently, the staple fibers are deposited onto a forming surface with a conventional carding process, e.g., a woolen or cotton carding process, or air laid, to form a nonwoven web.

Polyolefins suitable for the present invention include polyethylene, e.g., high density polyethylene, medium density polyethylene, low density polyethylene and linear low density polyethylene; polypropylene, e.g., isotactic polypropylene and atactic polypropylene; polybutylene, e.g., poly(1-butene) and poly(2-butene); polypentene, e.g., poly(2-pentene), and poly(4-methyl-1-pentene); polyvinyl acetate; polyvinyl chloride; polystyrene; and copolymers thereof, e.g., ethylene-propylene copolymer; as well as blends thereof. Of these, more desirable polyolefins are polypropylene, polyethylene, polybutylene, polypentene, polyvinyl acetate, and copolymers and blends thereof. Most desirable polyolefins for the present invention are polypropylene and polyethylene, more particularly, isotactic polypropylene, high density polyethylene, and linear low density polyethylene. In addition, the polyolefin component may further contain minor amounts of compatibilizing agents, abrasion resistance enhancing agents, crimp inducing agents and the like. Illustrative examples of such agents include acrylic polymer, e.g., ethylene alkyl acrylate copolymers; polyvinyl acetate; ethylenevinyl acetate; polyvinyl alcohol; ethylenevinyl alcohol and the like.

Polyamides, otherwise known as "nylons," suitable for the present invention include those which may be obtained by the polymerization of a diamine having two or more carbon atoms between the amine terminal groups with a dicarboxylic acid, or alternately those obtained by the polymerization of a monoamino carboxylic acid or an internal lactam thereof with a diamine and a dicarboxylic acid. Further, suitable polyamides may be derived by the condensation of a monoaminocarboxylic acid or an internal lactam thereof having at least two carbon atoms between the amino and the carboxylic acid groups, as well as other means.

Suitable diamines include those having the formula $$H_2N(CH_2)_nNH_2$$

wherein n preferably is an integer of 1–16, and includes such compounds as trimethylenediamine, tetramethylenediamine, pentamethylenediamine, hexamethylenediamine, octamethylenediamine, decamethylenediamine, dodecamethylenediamine, and hexadecamethylenediamine; aromatic diamines such as p-phenylenediamine, m-xylenediamine, 4,4'-diaminodiphenyl ether, 4,4'-diaminodiphenyl sulphone, 4,4'-diaminodiphenylmethane, alkylated diamines such as 2,2-dimethylpentamethylenediamine, 2,2,4-trimethylhexamethylenediamine, and 2,4,4-trimethylpentamethylenediamine, as well as cycloaliphatic diamines, such as diaminodicyclohexylmethane, and other compounds.

The dicarboxylic acids useful in the formation of polyamides are preferably those which are represented by the general formula $$HOOC—Z—COOH$$

wherein Z is representative of a divalent aliphatic radical containing at least 2 carbon atoms, such as adipic acid, sebacic acid, octadecanedioic acid, pimelic acid, subeic acid, azelaic acid, undecanedioic acid, and glutaric acid; or a divalent aromatic radical, such as isophthalic acid and terephthalic acid.

Illustrative examples of suitable polyamides include: polypropiolactam (nylon 3), polypyrrolidone (nylon 4), polycaprolactam (nylon 6), polyheptolactam (nylon 7), polycaprylactam (nylon 8), polynonanolactam (nylon 9), polyundecaneolactam (nylon 11), polydodecanolactam (nylon 12), poly(tetramethylenediamine-co-adipic acid) (nylon 4,6), poly(tetramethylenediamine-co-isophthalic acid) (nylon 4,I), polyhexamethylenediamine adipamide (nylon 6,6), polyhexamethylene azelaiamide (nylon 6,9), polyhexamethylene sebacamide (nylon 6,10), polyhexamethylene isophthalamide (nylon 6,I), polyhexamethylene terephthalamide (nylon 6,T), polymetaxylene adipamide (nylon MXD:6), poly(hexamethylenediamine-co-dodecanedioic acid) (nylon 6,12), poly(decamethylenediamine-co-sebacic acid) (nylon 10,10), poly(dodecamethylenediamine-co-dodecanedioic acid) (nylon 12,12),poly(bis[4-aminocyclohexyl]methane-co-dodecanedioic acid) (PACM-12), as well as copolymers of the above polyamides. By way of illustration and not limitation, such polyamide copolymers include: caprolactamhexamethylene adipamide (nylon 6/6,6), hexamethylene adipamide-caprolactam (nylon 6,6/6) as well as others polyamide copolymers which are not particularly delineated herein. Blends of two or more polyamides may also be employed. Polyamides more particularly suitable for use in the present invention are polycaprolactam (nylon 6), polyhexamethylene adipamide (nylon 6/6), and copolymers and blends thereof. Additionally, hydrophilic polyamide copolymers such as caprolactam and alkylene oxide, e.g., ethylene oxide, copolymers and hexamethylene adipamide and alkylene oxide copolymers are suitable for the present invention.

Desirably, the polyolefin and polyamide components are selected to have similar melt viscosities in order to simplify the fiber spinning process since, in general, polymers having similar melt viscosities can be more easily spun with conventional spinneret assemblies.

The nonwoven web of the present invention may further contain other fibers, e.g., monocomponent fibers, natural fibers, water-soluble fibers, bulking fibers, filler fibers and the like. Additionally, the conjugate fibers may contain conventional additives and modifying agents suitable for olefin polymers, e.g., wetting agents, antistatic agents, fillers, pigments, u.v. stabilizers, water-repelling agents and the like.

The invention is further described below with reference to the following examples which are in no way intended to limit the scope of the invention.

EXAMPLES

Examples 1–3 (Ex1–Ex3)

Three groups of point bonded nonwoven webs of about 1 ounce per square yard (osy) weight were prepared from polypropylene-sheath/nylon 6-core bicomponent spunbond fibers having different polymer weight ratios as indicated in Table 1. The polypropylene used was Exxon's PD3445 and the nylon 6 used was Custom Resin's 401-D, which had a sulfuric acid viscosity of 2.2. Polypropylene was blended with 2 wt % of a $TiO_2$ concentrate containing 50 wt % of $TiO_2$ and 50 wt % of a polypropylene, and the mixture was fed into a first single screw extruder. Nylon 6 was blended with 2 wt % of a $TiO_2$ concentrate containing 25 wt % of $TiO_2$ and 75 wt % of nylon 6, and the mixture was fed into a second single screw extruder. The extruded polymers were spun into round bicomponent fibers using a bicomponent spinning die, which had a 0.6 mm spinhole diameter and a 4:1 L/D ratio. The melt temperatures of the polymers fed into the spinning die were kept at 445° F., and the spinhole throughput rate was 0.7 gram/hole/minute. The bicomponent fibers exiting the spinning die were quenched by a flow of air having a flow rate of 45 SCFM/inch spinneret width and a temperature of 65° F. The quenching air was applied about 5 inches below the spinneret, and the quenched fibers were drawn in an aspirating unit of the type which is described in U.S. Pat. No. 3,802,817 to Matsuki et al. The quenched fibers were drawn with ambient air in the aspirating unit to attain 2.5 denier fibers. Then, the drawn fibers were deposited onto a foraminous forming surface with the assist of a vacuum flow to form an unbonded fiber web.

Figure 2:
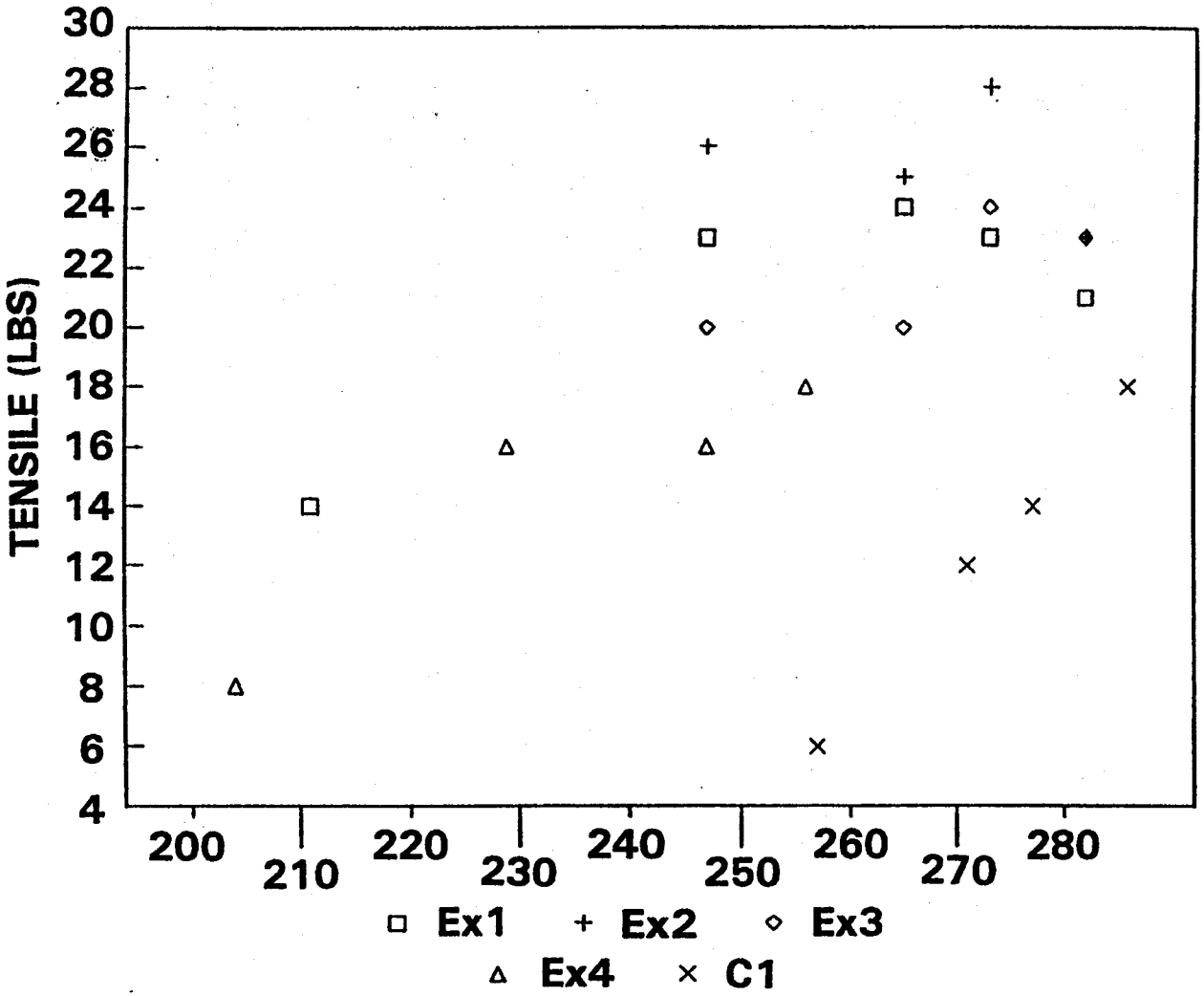
FIG. 2 is a graphical presentation of the CD tensile strength of the present point bonded fabrics and the control fabrics.

The unbonded fiber web was bonded at various bonding temperatures by passing the web through the nip formed by two bonding rolls, a smooth roll and a patterned roll, which were equipped with a temperature adjustable oil heating control. The patterned roll had a bond point density of 310 regularly spaced points per square inch, and the total surface area of the raised points covered about 15% of the roll surface. The two bonding rolls provided a nip pressure of about 87 pound per linear inch. The resulting bonded web was tested for its grab tensile strength in accordance with Federal Standard Methods 191A, Method 5100. The bonding temperatures and the grab tensile strength results are shown in Table 1, and the MD tensile strength values are graphically presented in FIG. 1 and the CD tensile values are presented in FIG. 2.

Control 1 (C1)

A monocomponent polypropylene fiber web was prepared and bonded by following the procedures of Example 1 using Exxon's PD 3445 polypropylene, except the spinning die was replaced with a homopolymer spinning die, which have a 0.6 mm spinhole diameter and a 4:1 L/D ratio, and the second extruder was not employed. The bonding temperatures and grab tensile results are shown in Table 1 and FIGS. 1 and 2.

Example 4 (Ex4)

Example 1 was repeated except linear low density polyethylene (LLDPE) was used in place of polypropylene and a different pattern bonding roll was utilized. The bonding pattern roll had about 25% of the total surface area covered by the raised pattern bond points and a bond point density of 200 regularly spaced points per square inch. The LLDPE used was Aspun 6811A, which is available from Dow Chemical. The bonding temperatures and grab tensile results are shown in Table 1 and FIGS. 1 and 2.

TABLE 1

| Example | Composition PP | LLDPE (wt %) | Nylon | Bonding Temperatures (°F.) 204 | 211 | 229 | 247 | 250 | 252 | 256 | 264 | 265 | 270 | 272 | 273 | 276 | 282 | 285 |
|---|---|---|---|---|---|---|---|---|---|---|---|---|---|---|---|---|---|---|
| | | | | MD Grab Tensile Strength (lbs) | | | | | | | | | | | | | | |
| Ex1 | 50 | — | 50 | — | 22 | — | 31 | — | — | — | — | 33 | — | — | 35 | — | 36 | — |
| Ex2 | 40 | — | 60 | — | — | — | 34 | — | — | — | — | 36 | — | — | 30 | — | 33 | — |
| Ex3 | 60 | — | 40 | — | — | — | 28 | — | — | — | — | 30 | — | — | 31 | — | 31 | — |
| Ex4 | — | 50 | 50 | 19 | — | 32 | 31 | — | — | 33 | — | — | — | — | — | — | — | — |
| C1 | 100 | — | 0 | — | — | — | — | — | — | 12 | — | — | 10 | — | — | 18 | — | 21 |
| | | | | CD Grab Tensile Strength (lbs) | | | | | | | | | | | | | | |
| Ex1 | 50 | — | 50 | — | 14 | — | 23 | — | — | — | — | 24 | — | — | 23 | — | 21 | — |
| Ex2 | 40 | — | 60 | — | — | — | 26 | — | — | — | — | 25 | — | — | 28 | — | 23 | — |
| Ex3 | 60 | — | 40 | — | — | — | 20 | — | — | — | — | 20 | — | — | 24 | — | 23 | — |
| Ex4 | — | 50 | 50 | 8 | — | 16 | 16 | — | — | 18 | — | — | — | — | — | — | — | — |
| C1 | 100 | | 0 | — | — | — | — | — | — | 6 | — | — | 12 | — | — | 14 | — | 18 |

As can be seen from the examples the point bonded fabrics of the present invention provide high tensile strength even at the low bonding temperatures where conventional monocomponent fiber fabrics do not form interfiber bonds of adequate strength. Additionally, the strength results of Example 2 and Example 3 demonstrate that the improved strength of the present fabrics cannot be explained by the strength of nylon component since Example 2, which contains a larger amount of nylon 6, did not exhibit significantly stronger tensile strength over Example 3. As will be further discussed below, it is believed that most of the strength of the fabrics is derived from the interfiber bond strength.

Figure 3:
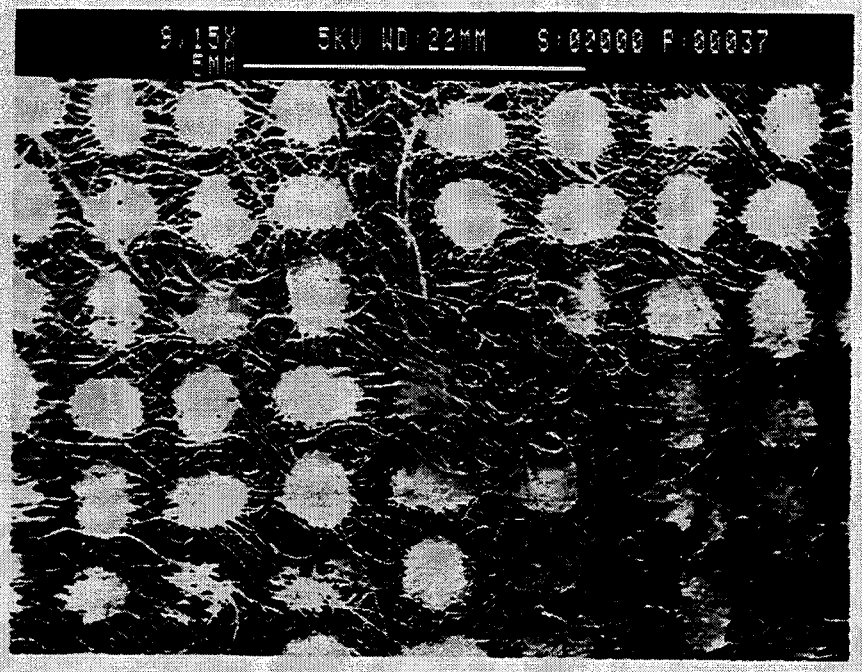
FIG. 3 is a scanning electron micrograph of a failed section of a present nonwoven fabric.
Figure 4:
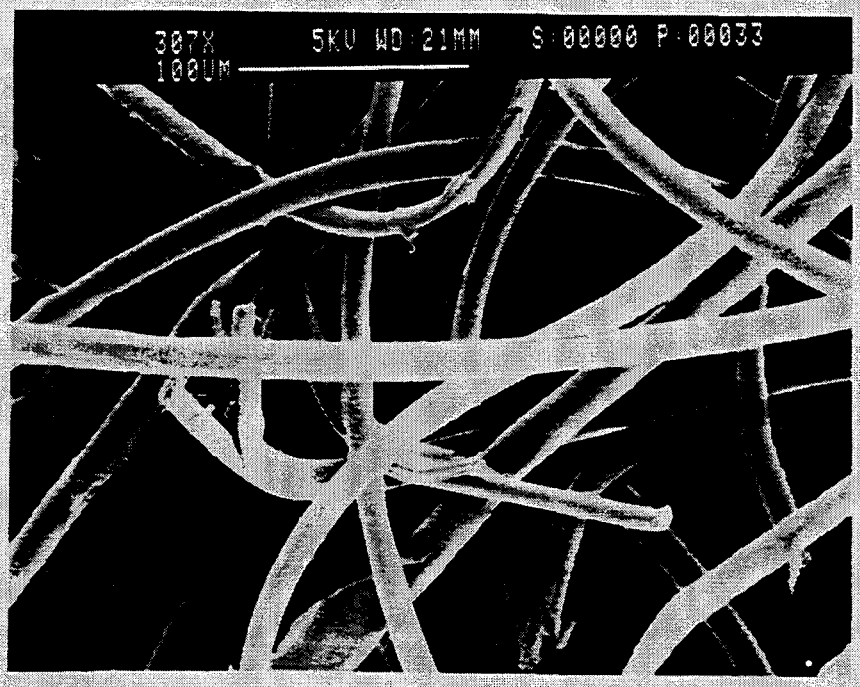
FIG. 4 is a magnified view the failed section of FIG. 3.
Figure 5:
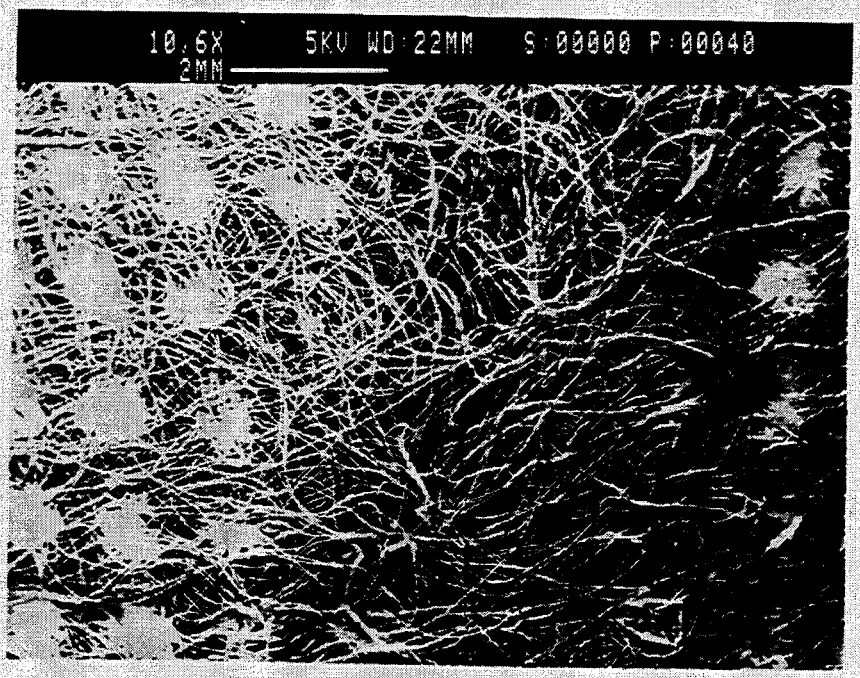
FIG. 5 is a scanning electron micrograph of a failed section of a conventional polypropylene nonwoven fabric.
Figure 6:
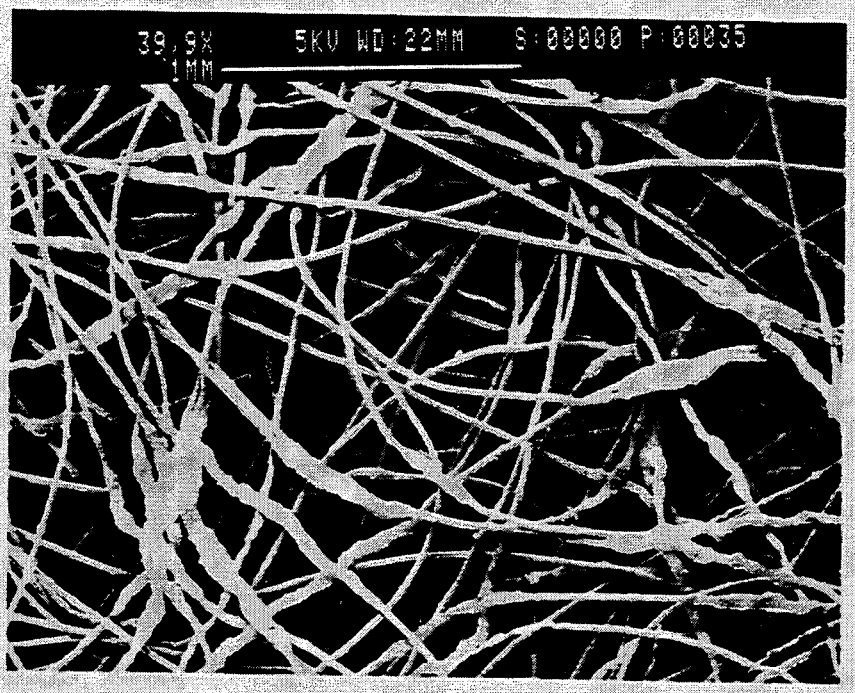
FIG. 6 is a magnified view the failed section of FIG. 5.

Turning to the figures, FIGS. 3 and 4 are scanning electron micrograph of a failed section of the test specimen of Example 1 that was bonded at 280° F. FIG. 3 shows that the bond points are largely intact even at the section of failure and the failure is the result of fiber breakage between the bond points. FIG. 4 is a magnified view of the failed section which clearly shows that the failure does not involve neither of the above-described conventional failure modes, i.e., the delamination failure mode and the bond point edge breakage failure mode. FIGS. 5 and 6 are scanning electron micrograph of a failed section of a test specimen of Control 1 that was bonded at 280° F. FIG. 5 shows that the bond points simply disintegrated and disappeared under the applied stress. FIG. 6, which is a magnified view of the section, clearly shows the conventional delamination failure of the bond points. Comparisons of the two example specimens and closer inspections of the failed section indicate that the failure of the point bonded present polypropylene/nylon bicomponent fabric resulted from the fracture of the fibers between the bond points, and does not involve the bond points at all. Surprisingly, unlike conventional bond points of nonwoven olefin fabrics, the bond points of the present fabrics are significantly stronger than the strength of the component fibers.

Example 5–7 (Ex5–Ex7)

For Example 5, strands of the bicomponent fibers produced during the preparation of the Example 1 test specimens were collected after the fibers were laid on the forming belt. For Examples 6 and 7, stands of the bicomponent conjugate fibers were produced in accordance with the procedure outlined in Example 1, except the fibers had a side-by-side conjugate fiber configuration. The fibers were tested for their individual fiber tenacity and strain response in accordance with the ASTM D3822 testing procedure, except the strain rate utilized was 12 inches per minute.

Control 2–3 (C2–C3)

Strands of monocomponent polypropylene fibers were collected from the nonwoven forming step of Control 1. The fibers were tested in accordance with the procedures outlined for Example 5.

TABLE 2

| Example | Configuration | Tenacity (gms/d) | Strain (%) |
|---|---|---|---|
| Ex5 | sheath/core | 2.7 | 105 |
| Ex6 | side-by-side | 1.9 | 105 |
| Ex7 | side-by-side | 2.3 | 77 |
| C2 | homopolymer | 2.7 | 252 |
| C3 | homopolymer | 3.1 | 257 |

The results of Table 2 demonstrate that the strength of the present fabrics is not attributable to the strength of individual fibers since the conjugate fibers containing nylon themselves are not stronger but even weaker than monocomponent polypropylene fibers.

The point bonded nonwoven fabric of the present invention fabricated from conjugate fibers having a polyolefin component and a nylon component provides an unexpectedly high interfiber bond strength even when the fabric is bonded at a temperature substantially lower than the conventional olefin nonwoven web bonding temperatures. Further, the bonded fabrics exhibit a high tensile strength that is not attributable to the strength of individual fibers, but attributable to the strength of the bond points. In addition, the present fabric can be bonded with a wide range of different bonding temperatures.

What is claimed is:

1. A process for producing a point-bonded nonwoven fabric of conjugate fibers having strong bond points, said conjugate fibers comprising a polyolefin and a polyamide, comprising:

a) depositing said conjugate fibers on a forming surface to form a nonwoven web, b) passing said web into a nip formed by two abutting bonding rolls, said bonding rolls being heated to a temperature lower than about 10° C. below the melting point of said polyolefin and providing a nip pressure on raised points between about 3,000 to about 180,000 psi.

2. The process of claim 1 wherein said point bonded fabric has a machine direction grab tensile strength of at least 15 lbs as measured in accordance with Federal Standard Methods 191A, Method 5100.

3. The process of claim 1 wherein said point bonded fabric has a grab tensile strength of at least 25 lbs as measured in accordance with Federal Standard Methods 191A, Method 5100.

4. The process of claim 1 wherein said conjugate fibers have a configuration selected from the group consisting of sheath/core and island-in-sea configurations.

5. The process of claim 1 wherein said conjugate fibers have a sheath/core configuration.

6. The process of claim 1 wherein said bonding rolls are heated to a temperature between about 20° C. to about 60° C. lower than the melting point of said polyolefin.

7. The process of claim 1 wherein said polyolefin is selected from the group consisting of polyethylene, polypropylene, polybutylene, polypentene, polyvinyl acetate, and copolymers and blends thereof.

8. The process of claim 1 wherein said polyolefin is selected from the group consisting of polypropylene and polyethylene.

9. The process of claim 1 wherein said polyamide is selected from the group consisting of polycaprolactam, polyhexamethylenediamine adipamide, copolymers of caprolactam and hexamethylenediamine adipamide, copolymers of caprolactam or hexamethylenediamine adipamide and ethylene oxide, and blends thereof.

10. A point bonded nonwoven fabric of conjugate fibers produced according to the process of claim 1.

11. A point bonded nonwoven conjugate fiber web having point bonds that are stronger than the conjugate fibers comprising said web, said conjugate fibers comprising a polyolefin component and a polyamide component, said polymer components being arranged to occupy substantially distinct sections of each of said conjugate fibers along the length of said fibers, and said bond points being formed in a nip between two abutting heated bonding rolls which are heated to a temperature lower than about 10° C. below the melting point of said polyolefin and providing a nip pressure on raised points between about 3,000 to about 180,000 psi.

12. The point bonded nonwoven web of claim 11 wherein said conjugate fibers have a configuration selected from the group consisting of sheath/core and island-in-sea configurations.

13. The point bonded nonwoven web of claim 11 wherein said conjugate fibers have a sheath/core configuration.

14. The point bonded nonwoven web of claim 11 wherein said bonding rolls are heated to a temperature between about 20° C. to about 60° C. lower than the melting point of said polyolefin.

15. The point bonded nonwoven web of claim 11 wherein said polyolefin is selected from the group consisting of polyethylene, polypropylene, polybutylene, polypentene, polyvinyl acetate, and copolymers and blends thereof.

16. The point bonded nonwoven web of claim 11 wherein said polyamide is selected from the group consisting of polycaprolactam, polyhexamethylenediamine adipamide, copolymers of caprolactam and hexamethylenediamine adipamide, copolymers of caprolactam or hexamethylenediamine adipamide and ethylene oxide, and blends thereof.

17. A point bonded nonwoven fiber web having a wide bonding temperature range, said fiber web comprising conjugate fibers which comprise a polyolefin component and a polyamide component and said polymer components being arranged to occupy substantially distinct sections of each of said conjugate fibers along the length of said fibers.

18. The nonwoven web of claim 17 wherein said conjugate fibers have a sheath/core or island-in-sea configuration.

19. The nonwoven web of claim 17 wherein said polyolefin is selected from the group consisting of polyethylene, polypropylene, polybutylene, polypentene, polyvinyl acetate, and copolymers and blends thereof.

20. The nonwoven web of claim 17 wherein said polyamide is selected from the group consisting of polycaprolactam, polyhexamethylenediamine adipamide, copolymers of caprolactam and hexamethylenediamine adipamide, copolymers of caprolactam or hexamethylenediamine adipamide and ethylene oxide, and blends thereof.

* * * * *